US007010884B2

(12) United States Patent
Yamamoto

(10) Patent No.: US 7,010,884 B2
(45) Date of Patent: Mar. 14, 2006

(54) WINDOW REGULATOR

(75) Inventor: Kenji Yamamoto, Kanagawa (JP)

(73) Assignee: Shiroki Kogyo Co., Ltd., Kanagawa (JP)

( * ) Notice: Subject to any disclaimer, the term of this patent is extended or adjusted under 35 U.S.C. 154(b) by 105 days.

(21) Appl. No.: 10/817,815

(22) Filed: Apr. 6, 2004

(65) Prior Publication Data

US 2005/0072050 A1 Apr. 7, 2005

(30) Foreign Application Priority Data

Oct. 6, 2003 (JP) ..... 2003-346749
Oct. 9, 2003 (JP) ..... 2003-350676

(51) Int. Cl.
*E05F 11/48* (2006.01)

(52) U.S. Cl. ..... 49/352

(58) Field of Classification Search ..... 49/348, 49/349, 352, 502

See application file for complete search history.

(56) References Cited

U.S. PATENT DOCUMENTS

| | | | | |
|---|---|---|---|---|
| 4,920,697 A * | 5/1990 | Vail et al. | ..... | 49/348 |
| 5,020,850 A * | 6/1991 | Bienert et al. | ..... | 296/223 |
| 5,035,083 A * | 7/1991 | Kruzich | ..... | 49/352 |
| 5,398,449 A * | 3/1995 | Kobrehel et al. | ..... | 49/352 |
| 2004/0003544 A1 * | 1/2004 | Berry et al. | ..... | 49/374 |

FOREIGN PATENT DOCUMENTS

| | | | | |
|---|---|---|---|---|
| EP | 00491320 A1 * | 12/1991 | ..... | 49/352 |
| JP | A-63-60383 | 3/1988 | | |
| JP | A-427093 | 1/1992 | | |
| JP | 02004124703 A * | 4/2004 | ..... | 49/352 |
| JP | 02004176270 A * | 6/2004 | ..... | 49/352 |

* cited by examiner

*Primary Examiner*—Jerry Redman
(74) *Attorney, Agent, or Firm*—Finnegan, Henderson, Farabow, Garrett & Dunner, L.L.P.

(57) ABSTRACT

A window regulator to be disposed in a vehicle comprises: a first frame disposed on one side of the longitudinal direction of a door and extending in the directions for a door glass to go up and down; a second frame disposed on the other side of the longitudinal direction of the door and extending in the upward and downward directions of the door glass; an upper frame disposed to span the upper portion of the first frame and the upper portion of the second frame; a wire tensed in an annular shape along the first frame, the upper frame and the second frame and having a return portion for a backward run in the first frame; a first wire fixing member disposed on one side of the longitudinal direction of the door glass and retained by the return portion of the wire to move along the first frame; a second wire fixing member disposed on the other side of the longitudinal direction of the door glass and retained by the wire portion to move along the second frame; and a drum disposed on the inner side of the door panel of the door and wound with a portion of the wire for moving the annularly tensed wire back and forth when it is turned.

8 Claims, 18 Drawing Sheets

WINDOW REGULATOR

BACKGROUND OF THE INVENTION

1. Field of the Invention

The present invention relates to a wire type window regulator to be disposed in a vehicle or the like for opening/closing a door glass.

2. Description of the Related Art

As the related art of this kind, there can be exemplified the disclosure of JP-A-4-27093. This related art will be described with reference to FIG. 1.

As shown in FIG. 1, a door is provided at its front portion with a guide rail 3, which extends in the directions for a door glass 1 to go up and down. The door is further provided at its rear portion with a guide rail 5, which extends in the directions for the door glass 1 to go up and down.

Moreover, a roller 7 movably engages with the guide rail 3, and a roller 9 and a roller 11 movably engage with the guide rail 5.

The door panel is provided in its central space with a guide rail 13 extending in the directions for the door glass 1 to go up and down. With this guide rail 13, there engages a slider 15, which is disposed at the center of the lower portion of the door glass 1 such that it can go up and down.

A pulley 17 is fixed at the upper portion of the guide rail 13, and a pulley 19 is fixed at the lower portion of the guide rail 13.

A wire 23 has an intermediate portion made to run on a drum 21. One end portion of the wire 23 is retained by the slider 15 through the pulley 17, and the other end portion is retained by the slider 15 through the pulley 19.

As the drum 21 is turned, therefore, the wire 23 is taken up at its one end side by the drum 21 but let off at its other end side so that it can be moved forward or backward to move the door glass 1 upward and downward in accordance with the turning direction of the drum 21.

In the window regulator thus constructed, not only the drum 21 and the wire 23 but also the guide rail 13 are disposed at the center of the inside space of the door panel. As a result, there arises a problem that it is impossible to make effective use of the space in the door panel.

As another related art, there can be exemplified the disclosure of JP-A-63-60383. This related art will be described with reference to FIG. 2. In FIG. 2, a pulley 31 and a pulley 33 are disposed in the upper portion inside of the door panel, and a pulley 35 and a pulley 37 are disposed in the lower portion inside of the door panel.

A wire 39 is made to run in the shape of letter "N" on the pulley 35, the pulley 31, the pulley 37 and the pulley 33 in the recited order and further on a drum 41.

A door glass 43 is attached at its lower portion through the not-shown brackets to the wire portion between the pulley 31 and the pulley 35 and to the wire portion between the pulley 33 and the pulley 37.

Therefore, the door glass 43 can be moved up and down by turning the drum 41 to move the wire 39 back and forth.

In the window regulator having the construction shown in FIG. 2, the wire 39 made to run in the N-shape is arranged all over the door panel inside. This arrangement raises a problem that it is impossible to make effective use of the space in the door panel. In the window regulator having the construction shown in FIG. 2, moreover, the wire 39 has the intersection. This intersection raises another problem that the wire 39 generates interference noises when they are flapped by vibrations or the like.

SUMMARY OF THE INVENTION

An object of the invention is to provide a window regulator, which can make effective use of the space in the door panel.

The above-specified object is achieved by a window regulator which comprises: a first frame disposed on one side of the longitudinal direction of a door and extending in the directions for a door glass to go up and down; a second frame disposed on the other side of the longitudinal direction of the door and extending in the upward and downward directions of the door glass; an upper frame disposed to span the upper portion of the first frame and the upper portion of the second frame; a wire tensed in an annular shape along the first frame, the upper frame and the second frame and having a return portion for a backward run in the first frame; a first wire fixing member disposed on one side of the longitudinal direction of the door glass and retained by the return portion of the wire to move along the first frame; a second wire fixing member disposed on the other side of the longitudinal direction of the door glass and retained by the wire portion to move along the second frame; and a drum disposed on the inner side of the door panel of the door and wound with a portion of the wire for moving the annularly tensed wire back and forth when it is turned.

In short, according to the invention, the wire is arranged along the first frame, the upper frame and the second frame. Moreover, what resides in the space inside of the door frame is the drum to move the wire back and forth and the wire to go toward the drum, so that the space inside of the door panel can be effectively utilized.

Other features and advantages of the invention will become more apparent from the embodiments to be described hereinafter with reference to the accompanying drawings.

DETAILED DESCRIPTION OF THE INVENTION

A first embodiment of the invention will be described with reference to FIG. 3 to FIG. 10. This embodiment is applied to a left-hand front door in a sedan type automobile.

Figure 1:
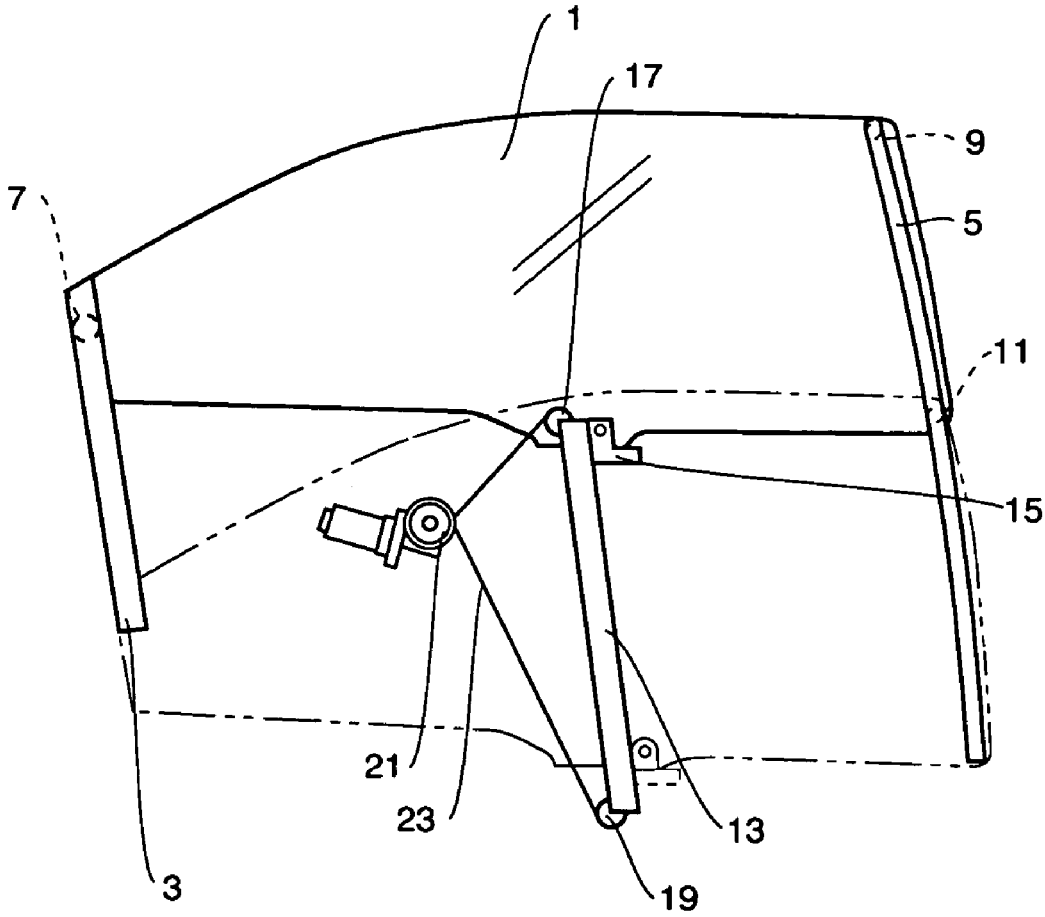
FIG.1 PRIOR ART
FIG. 1 is a diagram showing a first related art.
Figure 2:
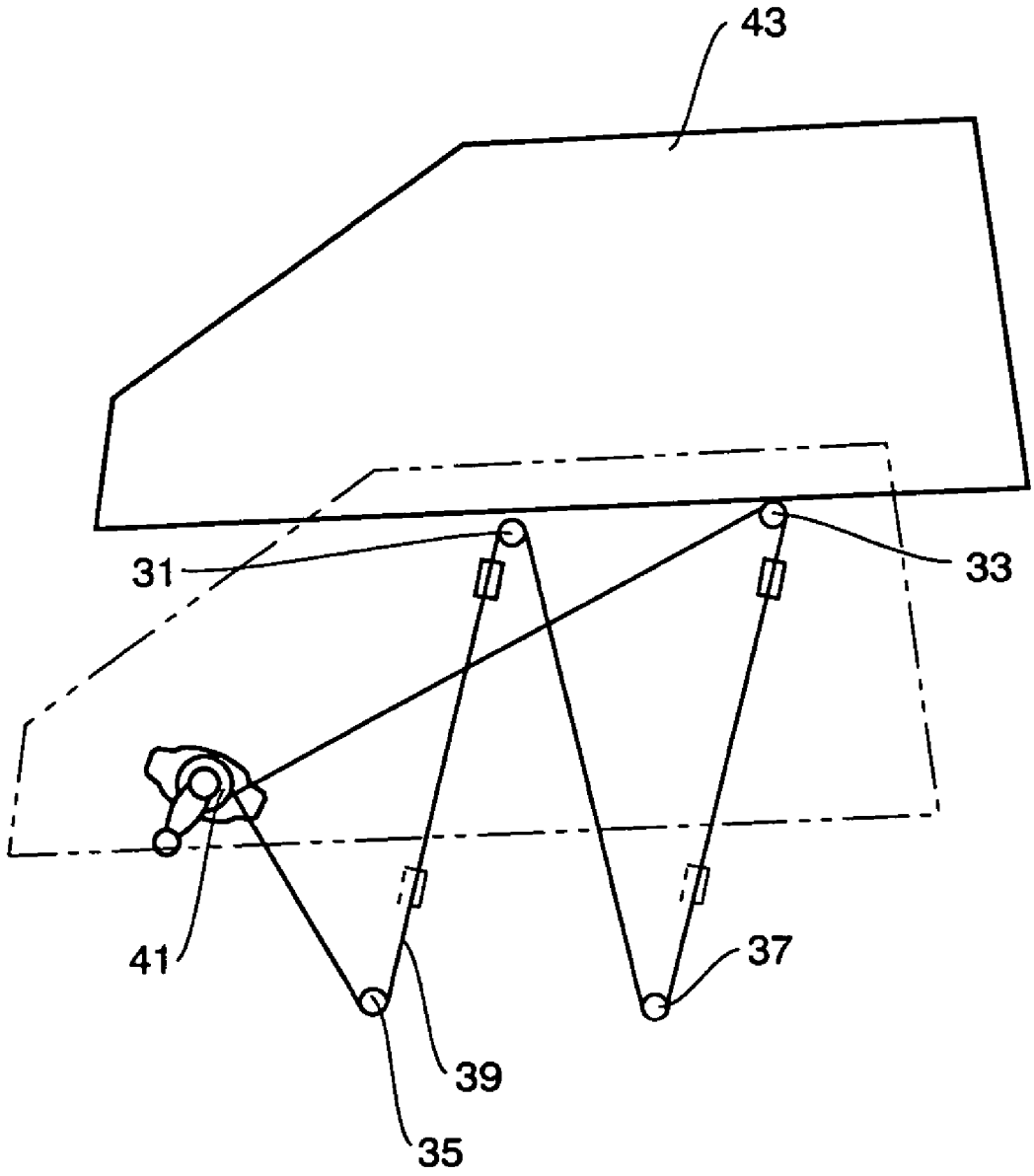
FIG.2 PRIOR ART
FIG. 2 is a diagram showing a second related art.
Figure 3:
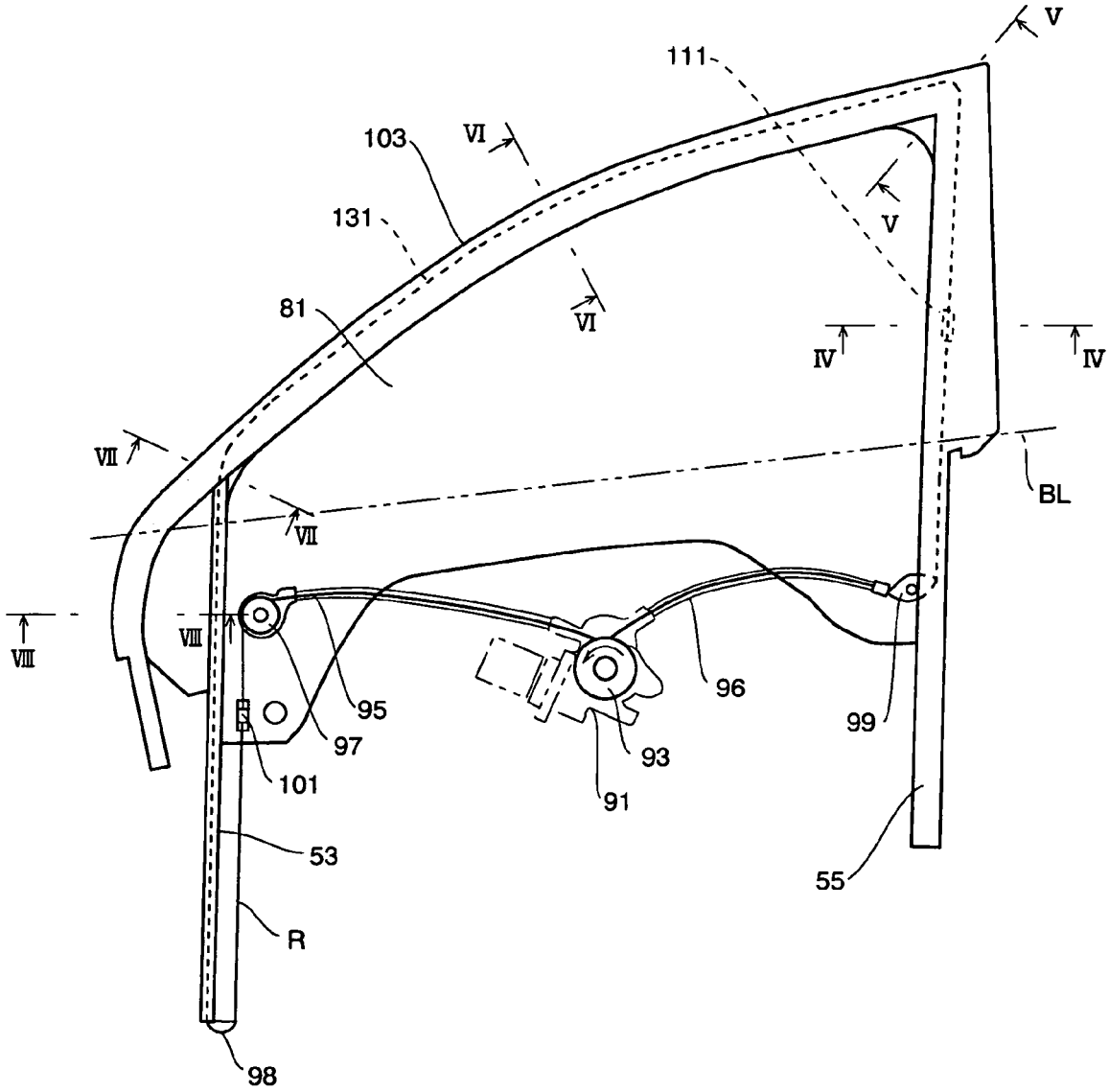
FIG. 3 is a construction diagram showing a first embodiment of a window regulator according to the invention.
Figure 4:
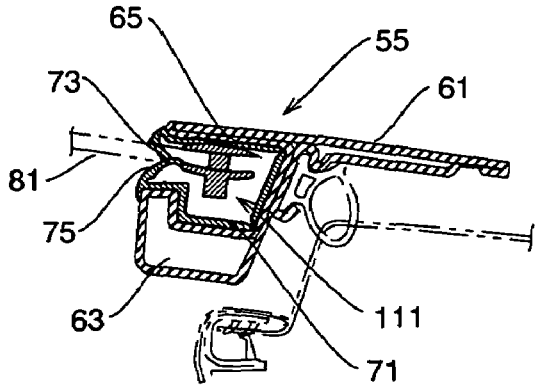
FIG. 4 is a sectional view taken along line IV—IV of FIG. 3.

In FIG. 3, reference letters BL designate a door belt line, which extends on the upper end of a door panel. The door is provided on its front side with a front frame 53 or a first frame extending in the directions for a door glass 81 to go up and down. The door is provided on its rear side with a rear frame 55 or a second frame extending in the directions for the door glass 81 to go up and down. The upper portion of the front frame 53 and the upper portion of the rear frame 55 are spanned with an upper frame 103.

As shown in FIG. 4 to FIG. 8, the front frame 53, the rear frame 55 and the upper frame 103 have different sectional shapes, but each of them is provided with an ornamental portion 61 exposed to the outside, a hollow member 63 having a closed sectional shape, and a glass run mounting portion 65 for mounting a glass run 71.

The glass runs 71 are mounted on the individual glass run mounting portions 65 of the front frame 53, the rear frame 55 and the upper frame 103. The glass run 71 is formed by integrating a lip 73 to abut against the surface of the door glass 81 and a lip 75 to abut against the back face of the door glass 81. Generally, the glass runs have a variety of sectional shapes including a U-shaped section. The sectional shape of the glass runs 71 used herein should not be limited to any one.

A first wire fixing member 101 is mounted on the lower portion of the front side of the door glass 81, and a second wire fixing member 111 is mounted on the upper portion of the rear side of the door glass 81.

In this embodiment, the second wire fixing member 111 is set to go up and down with a stroke across the belt line BL. This second wire fixing member 111 is disposed in the glass run 71 of the rear frame 55.

Inside of the door panel, there are disposed a motor 91 and a drum 93 to be rotationally driven by the motor 91. Two wires 95 and 96 are made to run on the drum 93. The wire 95 and the wire 96 are wound in such directions that the wire 95 is let off whereas the wire 96 is taken up as the drum 93 is turned in the direction of arrow of FIG. 3.

The wire 95 is made at its leading end portion to run on a pulley 97 disposed at the upper portion of the front frame 53, and is so extended downward along the front frame 53 that it is retained by the first wire fixing member 101. On the other hand, the wire 96 is introduced into the glass run 71 of the rear frame 55 through a guide 99 disposed in the rear frame 55 and is retained by the second wire fixing member 111.

By the first wire fixing member 101, on the other hand, there is retained one end of a wire 131. This wire 131 is extended downward along the front frame 53 and is so introduced into the glass run 71 of the front frame 53 through a guide 98 disposed at the lower portion of the front frame 53 that it is extended upward. Moreover, the wire 131 passes through the glass run 71 of the upper frame 103 and further through the glass run 71 of the rear frame 55 and is retained by the second wire fixing member 111.

Figure 5:
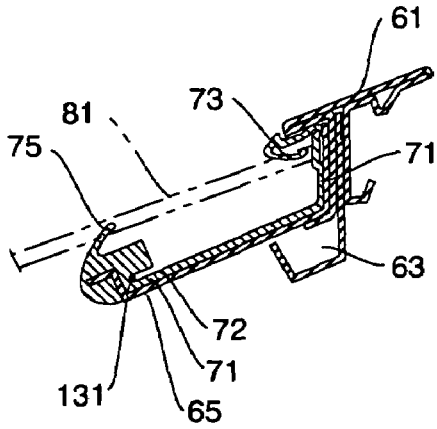
FIG. 5 is a sectional view taken along line V—V of FIG. 3.
Figure 6:
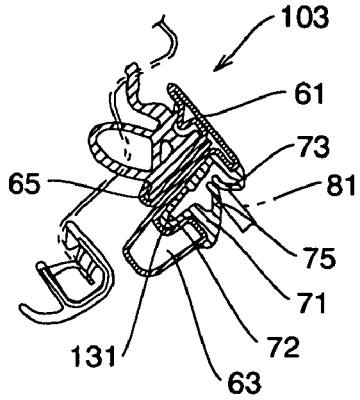
FIG. 6 is a sectional view taken along line VI—VI of FIG. 3.
Figure 7:
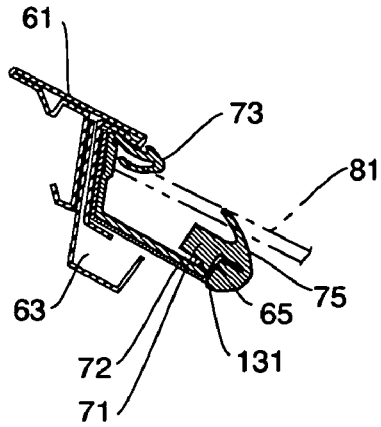
FIG. 7 is a sectional view taken along line VII—VII of FIG. 3.
Figure 8:
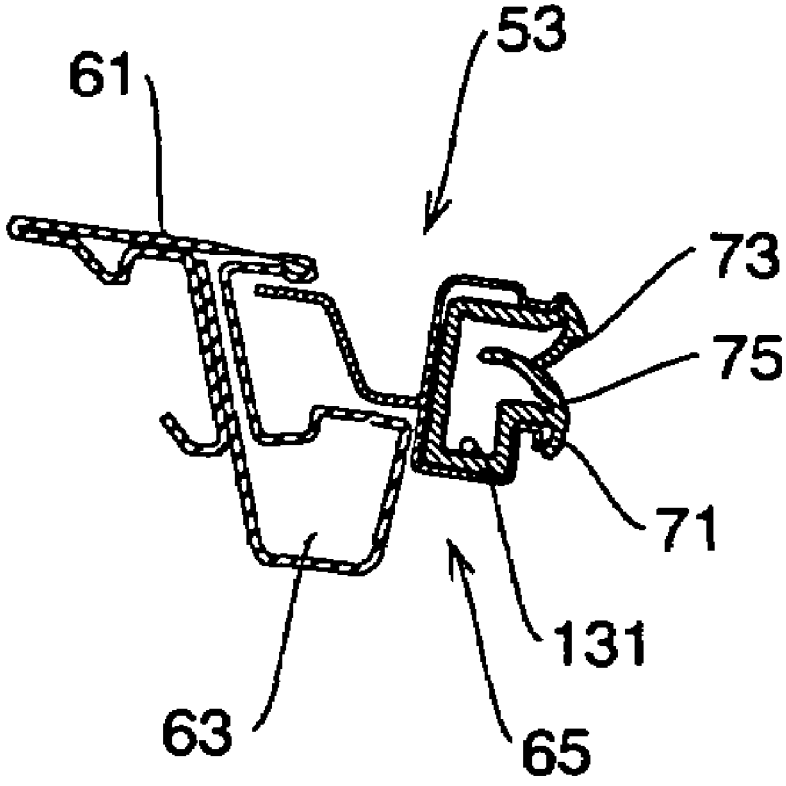
FIG. 8 is a sectional view taken along line VIII—VIII of FIG. 3.

Here in such a portion of the glass run 71 that the wire 131 might otherwise come out, as shown in FIG. 5 to FIG. 7, there is formed a groove 72 for engaging with the wire 131 to prevent it from coming out.

The wire 95, the wire 96 and the wire 131 thus far described form a continuous wire tensed in an annular shape. In this continuous wire, moreover, there is formed a return portion R (i.e., the wire portion located between the pulley 97 and the guide 98), which runs backward of the moving direction of the wire 131 in the front frame 53.

Moreover, the first wire fixing member 101 retains the return portion R to go up and down along the front frame 53, and the second wire fixing member 111 retains the wire portion to go up and down along the rear frame 55.

Figure 9:
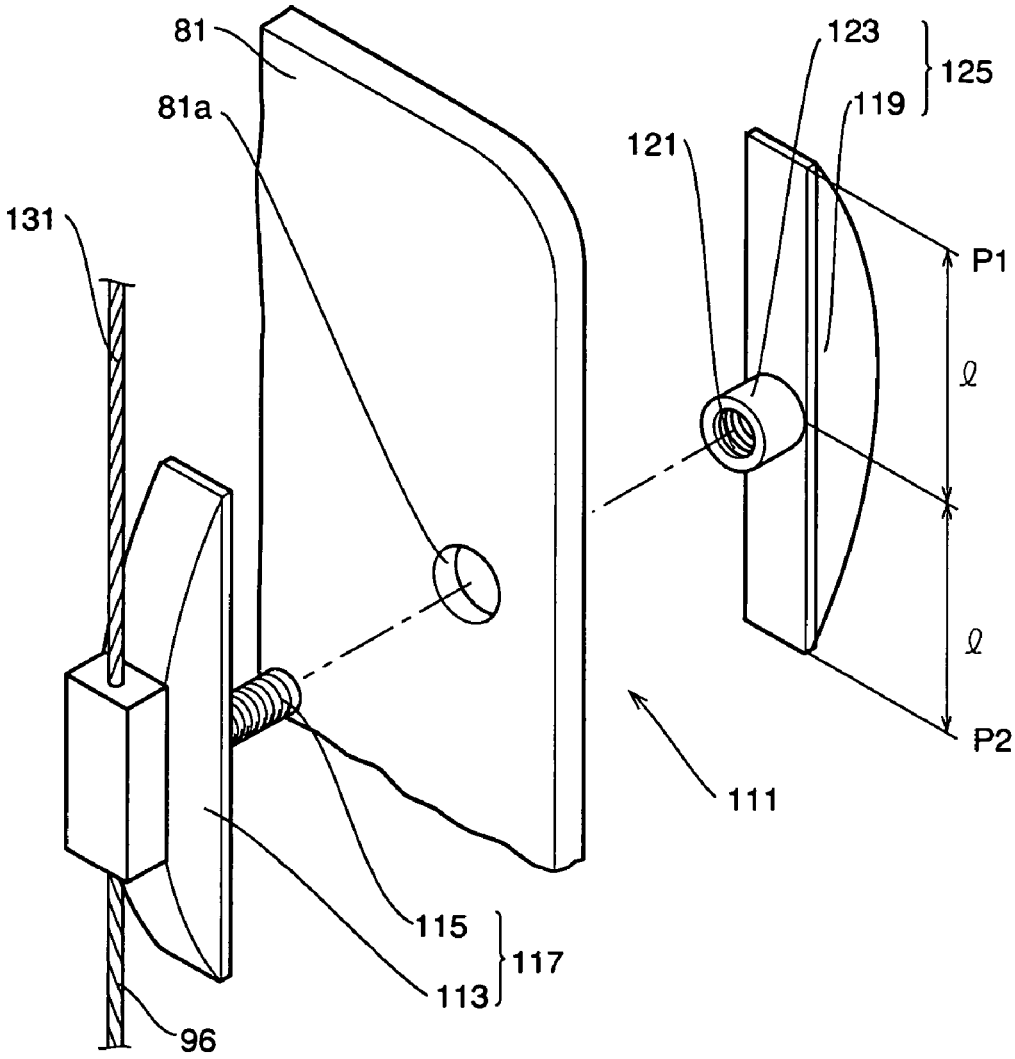
FIG. 9 is a perspective view showing a second wire fixing member.
Figure 10:
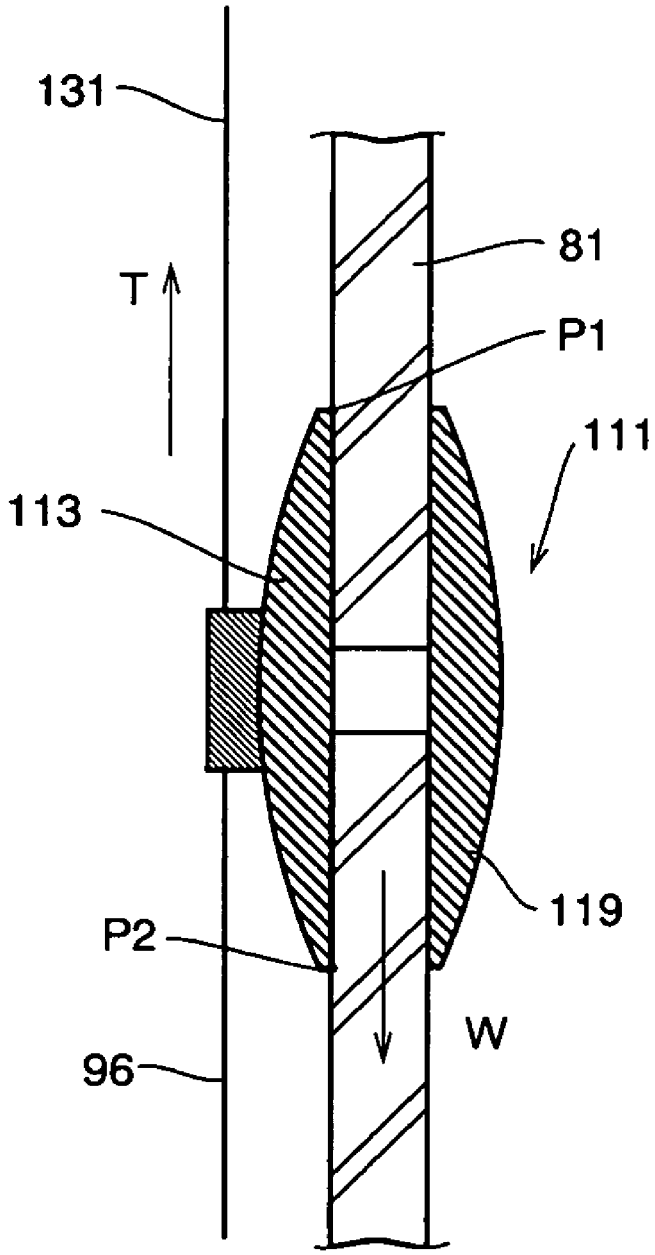
FIG. 10 is a sectional view showing a second wire fixing member.

In this embodiment, the first wire fixing member 101 and the second wire fixing member 111 are likewise constructed. With reference to FIG. 9 and FIG. 10, therefore, their constructions will be described by taking the second wire fixing member 111 as an example.

As shown in FIG. 9, the second wire fixing member 111 is constructed to include a bolt 117 and a nut 125. The bolt 117 is composed of: a head portion 113 retaining the wire 131 and the wire 96 and having a face to abut against the door glass 81; and a neck portion 115 made integral with the head portion 113. This neck portion 115 is externally threaded in its circumference and is inserted into the hole 81*a* of the door glass 81. The nut 125 is composed of: a head portion 119 having a face to abut against the door glass 81; and a neck portion 123 made integral with the head portion 119. This neck portion 123 is inserted into the hole 81*a* formed in the door glass 81, and has an internally threaded hole 121 to be fastened on the neck portion 115 of the bolt 117.

The face of the head portion 113 of the bolt 117 to abut against the door glass 81 and the face of the head portion 119 of the nut 125 to abut against the door glass 81 are shaped such that the sizes taken in the direction along the wire 131 are larger than those taken in the direction perpendicular to the wire 131.

Of the face of the head portion 113 of the bolt 117 to abut against the door glass 81 and the face of the head portion 119 of the nut 125 to abut against the door glass 81, moreover, the size in the direction perpendicular to the wire 131 is so set in the bolt 117 as to be substantially equal to the external diameter of the neck portion 115 and in the nut 125 as to be substantially equal to the external diameter of the neck portion 123.

Here will be described the actions of the first embodiment. As a drum 93 is turned in the direction of arrow by the motor 91 with the door glass 81 being in a fully closed state, as shown in FIG. 3, the wire 95 is let off from the drum 93, and the wire 96 is taken up on the drum 93. Therefore, the first wire fixing member 101 and the second wire fixing member 111 go down so that the door glass 81 also goes down. This downward movement is possible up to a fully open state, in which the upper end of the door glass 81 comes to the lower side of the belt line BL.

As the drum 93 is turned in the opposite direction of the arrow direction of FIG. 3 by the motor 91 with the door glass 81 being in the open state, on the contrary, the wire 95 is taken up on the drum 93, and the wire 96 is let off from the drum 93. In this case, the first wire fixing member 101 and the second wire fixing member 111 go up so that the door glass 81 also goes up.

In this embodiment, the construction for functioning to move the door glass 81 up and down, i.e., the construction including the wire 95, the wire 96, the wire 131, the first wire fixing member 101 and the second wire fixing member 111 is disposed along the front frame 53, the upper frame 103 and the rear frame 55. What exists in the space at the center of the inside of the door frame is the drum 93 for moving the wire back and forth and the wires 95 and 96 for moving toward the drum 93, so that the construction can make effective use of the space inside of the door panel.

Above the belt line BL, on the other hand, the construction for functioning to move the door glass 81 up and down is arranged in the glass run 71. Specifically, the wire 131 is arranged in the individual glass runs 71 of the front frame 53, the upper frame 103 and the rear frame 55, and the second wire fixing member 111 is arranged in the glass run 71 of the rear frame 55. Therefore, these arrangements give a neat appearance.

The disposition of the second wire fixing member 111 in the glass run 71 eliminates the interference between the second wire fixing member 111 and the belt molding (i.e., the weather strip disposed in the belt line to prevent the rain water from entering the space between the door inner panel and the door outer panel). When the door glass 81 is moved up and down, therefore, it is possible to prevent the unusual noises, which might otherwise be caused by the interference of the second wire fixing member 111 with the belt molding. In case the window regulator is of the power type, moreover, a safety device is activated by the interference, if caused, between the second wire fixing member 111 and the belt molding when the door glass 81 goes up, so that the door glass 81 can be prevented from going down.

In this embodiment, here is noted the transmission of the upward and downward moving forces from the second wire fixing member 111 to the door glass 81. These forces are applied from the tensed wire 96 or the tensed wire 131 to the second wire fixing member 111 and are transmitted to the door glass 81 through the abutting face on the second wire fixing member 111 against the door glass 81.

In the plane parallel to the wire moving direction and normal to the door glass 81, as shown in FIG. 10, a force T to act on the second wire fixing member 111 from the wire 131 or the wire 96 and a gravitational force W to act on the door glass 81 pass each other so that a moment acts on the door glass 81.

Therefore, pushing forces act on the door glass 81 from the edge portions P1 and P2, as taken in the wire direction, of the abutment faces of the second wire fixing member 111 against the door glass 81. On the other hand, the direction of the force to be applied to the second wire fixing member 111 is only the wire tensing direction, and no other force is applied.

In this embodiment, in connection with the shapes of the face of the head portion 113 of the bolt 117 to abut against the door glass 81 and the face of the head portion 119 of the nut 125 to abut against the door glass 81, the sizes taken in the direction along the wire 131 are set larger than those taken in the direction perpendicular to the wire 131. As a result, the pushing forces to act on the door glass 81 are reduced. This makes it possible to prevent the door glass 81 from being broken. In this embodiment, the first wire fixing member 101 has the same structure as that of the second wire fixing member 111 so that it can achieve the same effects.

Moreover, the shapes of the face of the head portion 113 of the bolt 117 to abut against the door glass 81 and the face of the head portion 119 of the nut 125 to abut against the door glass 81, the sizes taken in the direction along the wire 131 are set larger than those taken in the direction perpendicular to the wire 131. This setting makes it possible to reduce the sectional shape of the glass run 71 and the sectional shapes of the front frame 53 and the rear frame 55 thereby to improve the appearance.

In this embodiment, moreover, of the face of the head portion 113 of the bolt 117 to abut against the door glass 81 and the face of the head portion 119 of the nut 125 to abut against the door glass 81, moreover, the size in the direction perpendicular to the wire 131 is so set in the bolt 117 as to be substantially equal to the external diameter of the neck portion 115 and in the nut 125 as to be substantially equal to the external diameter of the neck portion 123. This setting makes it possible to minimize the sectional shape of the glass run 71 and further the sectional shapes of the front frame 53 and the rear frame 55 thereby to improve the appearance.

In this embodiment, there is no intersection among the wire 95, the wire 96 and the wire 131. Therefore, these wires generate no interference noise even if they are flapped by vibrations or the like.

A second embodiment of the invention will be described with reference to FIG. 11 to FIG. 14.

What this embodiment is different from the first embodiment resides in that the drum 93 is disposed at a portion of the front frame 53 on the lower side of the belt line BL, and the remaining constructions are similar to those of the first embodiment. Therefore, the overlapping description will be omitted by designating the same portions in FIG. 11 to FIG. 14 as those in FIG. 3 to FIG. 10 by the common reference numerals.

Figure 11:
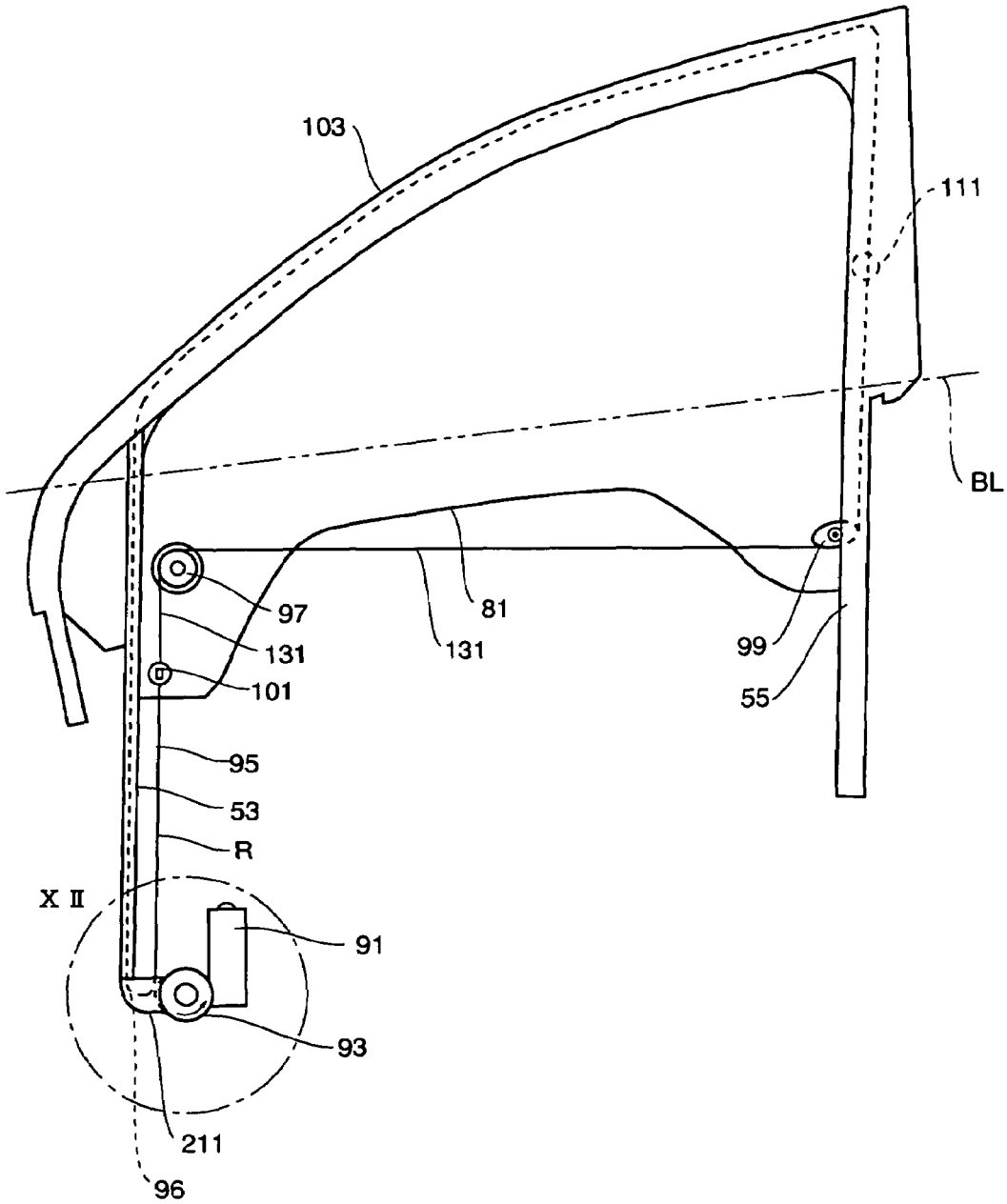
FIG. 11 is a construction diagram showing a second embodiment of a window regulator according to the invention.
Figure 12:
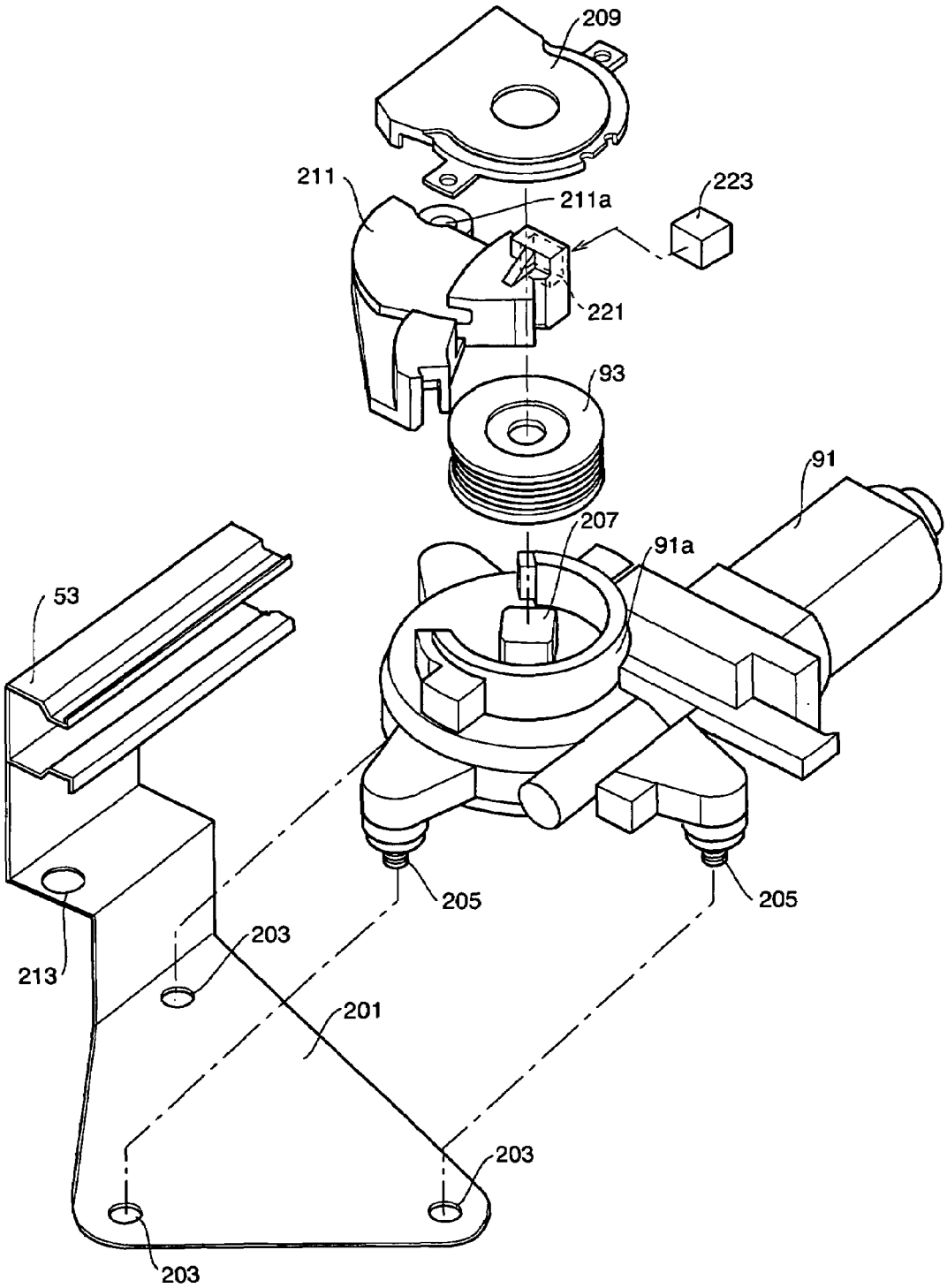
FIG. 12 is an enlarged, exploded perspective view of a portion XII of FIG. 11.

At the lower portion of the front frame 53, as shown in FIG. 11, there are disposed the drum 93 and the motor 91 for driving it rotationally. As shown in FIG. 12, more specifically, a bracket 201 is attached to the lower portion of the front frame 53. In this bracket 201, there are formed motor mounting holes 203, into which screws 205 belonging to the motor 91 are inserted. The not-shown nuts are fastened on the leading ends of the screws 205. As a result, the motor 91 is fixed on the bracket 201.

Around the output shaft 207 of the motor 91, there is formed a generally cylindrical drum housing 91*a*, which is cut out partially in its cylindrical face. In this drum housing 91*a*, there is rotatably housed the drum 93, which is fitted on the output shaft 207. On the other hand, the drum housing 91*a* has its open face covered with a motor cover 209.

Moreover, the drum housing 91*a* is provided with a wire guide 211, which closes the cut-out circumferential face of the drum housing 91*a*. The not-shown bolt is inserted into a mounting hole 211*a* of the wire guide 211 and a wire guide mounting hole 213 of the bracket 201. The wire guide 211 is fixed on the bracket 201 by fastening and fixing a nut on that bolt.

As shown in FIG. 11, the two wires 95 and 96 are made to run on the drum 93. Specifically, the wire 95 and the wire 96 are made to run on the drum 93 such that the wire 95 is let off whereas the wire 96 is taken up as the drum 93 is rotated in one direction.

The wire 95 is extended at its leading end portion along the front frame 53 through the wire guide 211 and is retained by the first wire fixing member 101. On the other hand, the wire 96 is extended at its leading end portion into the glass run 71 of the front frame 53 through the wire guide 211 and further through glass run 71 of the upper frame 103 and the glass run 71 of the rear frame 55 and is retained by the second wire fixing member 111.

On the other hand, the wire 131 is retained by the first wire fixing member 101 and is extended toward the rear frame 55 through the pulley 97 disposed at the upper portion of the front frame 53. The wire 131 is further extended into the glass run 71 of the rear frame 55 through the guide 99 and is retained by the second wire fixing member 111.

Figure 13:
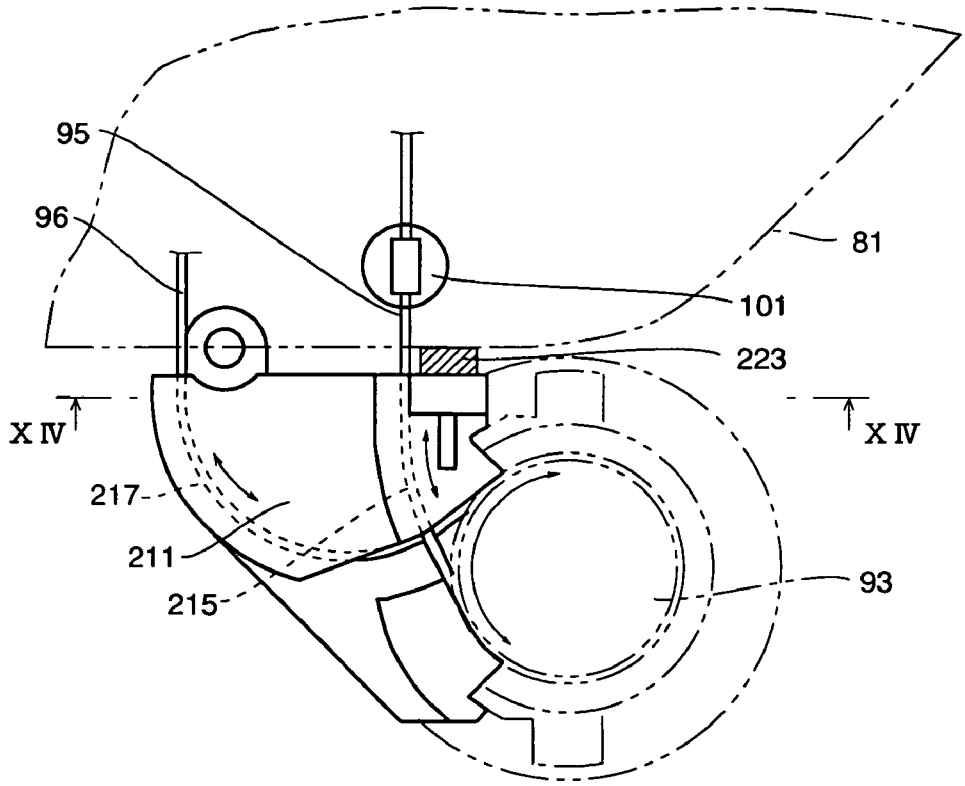
FIG. 13 is a diagram showing a wire guide of FIG. 12.
Figure 14:
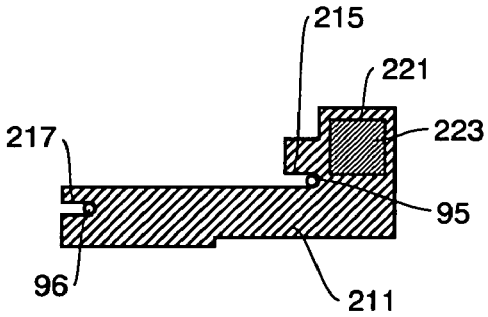
FIG. 14 is a sectional view taken along line XIV—XIV of FIG. 13.

In the wire guide 211, as shown in FIG. 13 and FIG. 14, there are formed a guide groove 215 for guiding the wire 95 toward the first wire fixing member 101, and a guide groove 217 for guiding the wire 96 toward the glass run 71 of the front frame 53.

At that portion of the wire guide 211 which confronts the lower edge of the door glass 81, on the other hand, there is formed a rectangular hole 221. In this hole 221, there is mounted a stopper 223, which is made of an elastic member for abutting the door glass 81 when this door glass 81 goes down to its lowermost position.

In this embodiment, too, the wire 95, the wire 96 and the wire 131 thus far described form a continuous wire tensed in an annular shape. In this continuous wire, moreover, there is formed a return portion R (i.e., the wire portion located between the pulley 97 and the drum 93), which runs backward of the moving direction of the wire 96 in the front frame 53.

Moreover, the first wire fixing member 101 retains the return portion R to go up and down along the front frame 53, and the second wire fixing member 111 retains the wire portion to go up and down along the rear frame 55.

Here will be described the actions of the second embodiment thus constructed.

As the drum 93 is turned in the direction of arrow by the motor 91 with the door glass 81 being in the fully closed state, as shown in FIG. 11, the wire 95 is taken up on the drum 93, and the wire 96 is let off from the drum 93. Therefore, the first wire fixing member 101 and the second wire fixing member 111 go down so that the door glass 81 also goes down.

As the drum 93 is turned in the opposite direction of the arrow direction by the motor 91 with the door glass 81 being in the open state, on the contrary, the wire 95 is let off from the drum 93, and the wire 96 is taken up on the drum 93. In this case, the first wire fixing member 101 and the second wire fixing member 111 go up so that the door glass 81 also goes up.

Like the first embodiment, the second embodiment can make effective use of the space inside of the door panel. Especially since the drum 93 is disposed at the lower portion of the front frame 53, the drum 93 and so on does not exist at the center of the space inside of the door panel so that the space can be more effectively utilized. Moreover, the appearance is also improved like the first embodiment.

A third embodiment of the invention will be described with reference to FIG. 15 and FIG. 16.

Figure 15:
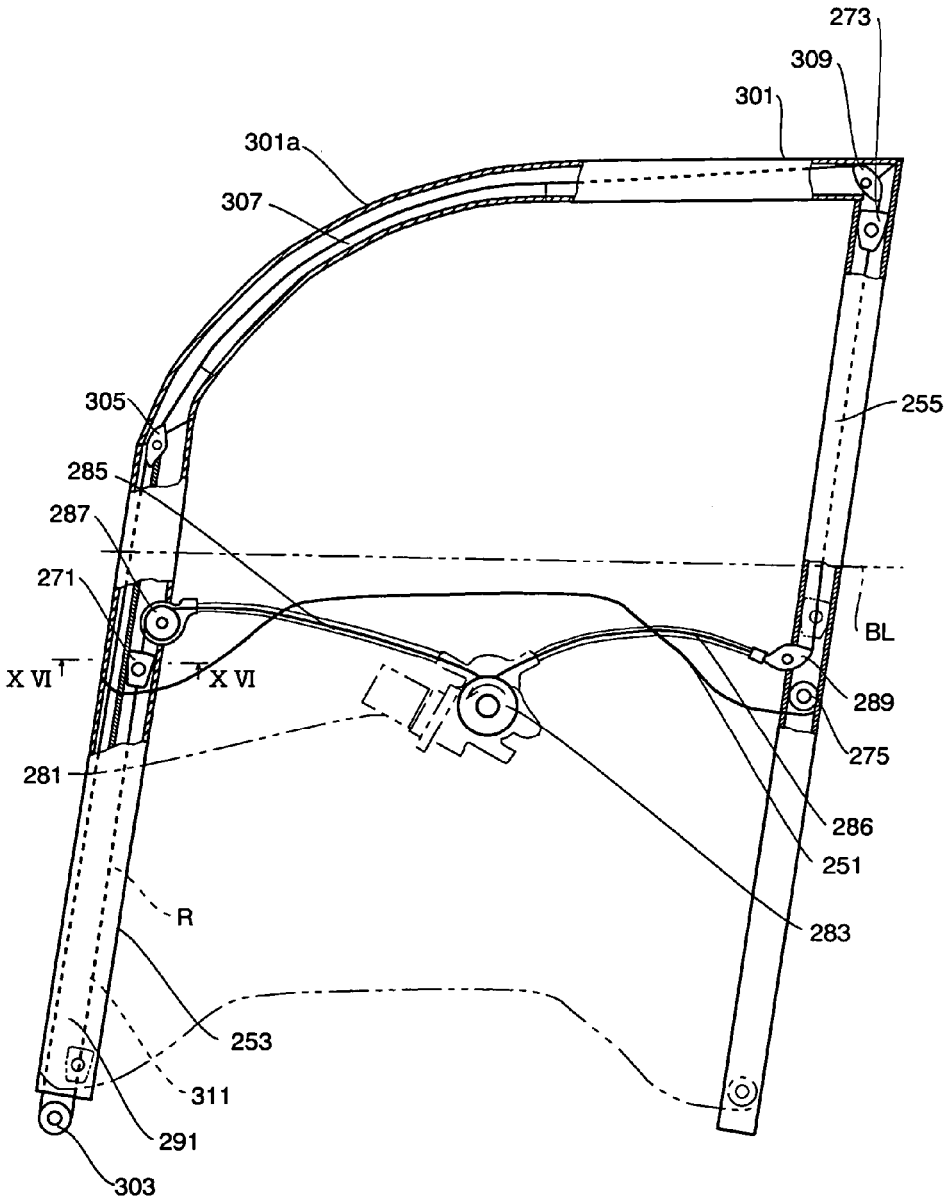
FIG. 15 is a construction diagram showing a third embodiment of a window regulator according to the invention.

As shown in FIG. 15, the door is provided on its front side with a front frame 253 or a first frame extending in the directions for a door glass 251 to go up and down. The door is provided on its rear side with a rear frame 255 or a second frame extending in the directions for the door glass 251 to go up and down.

Since the front frame 253 and the rear frame 255 have identical sectional shapes, the sectional shape of the front frame 253 will be described with reference to FIG. 16 while the description of the sectional shape of the rear frame 255 being omitted. As shown in FIG. 16, the front frame 253 is provided with: a base portion 257; a first side face portion 261 and a second side face portion 263 bent from the two sides of the base portion 257 and extending toward the outer side of a car body 259; and a first ceiling portion 267 and a second ceiling portion 269 bent toward each other from the leading end portions of the first side face portion 261 and the second side face portion 263 thereby to form a groove 265 having an opening in the outer side of the car body 259.

A first slider 271 or a first wire fixing member so engages with the front frame 253 as to move in the longitudinal directions. This first slider 271 is attached to the lower portion of the front side of the door glass 251 through the groove 265 of the front frame 253.

On the other hand, a second slider 273 having the same shape as that of the first slider 271 so engages with the rear frame 255 as to move as a second wire fixing member. This second slider 273 is attached to the upper portion of the rear side of the door glass 251 through the groove of the rear frame 255.

In this embodiment, moreover, a roller-shaped third slider 275 movably engages with the rear frame 255. This third slider 275 is attached to the lower portion of the rear side of the door glass 251 through the groove of the rear frame 255.

When the door glass 251 comes into its fully closed state (i.e., the state of FIG. 15), the second slider 273 is positioned above the belt line BL. The first slider 271 and the third slider 275 are always positioned on the lower side of the belt line BL.

Here will be described the connection structure of the first slider 271 and the door glass 251 with reference to FIG. 16. First of all, a through hole 251*a* is formed in the door glass 251, and a through hole 271*a* is formed in the first slider 271.

A pin 401 is composed of: a disc-shaped flange portion 403 having a larger external diameter than the internal diameter of the through hole 251*a* of the door glass 251; a neck portion 407 extending from the flange portion 403 and inserted into the through hole 251*a* of the door glass 251 and the through hole 271*a* of the first slider 271; and an external thread 405 formed in the leading end portion of the neck portion 407.

Moreover, that pin 401 is inserted from the outer side of the door glass 251 into the through hole 251*a* of the door glass 251 and the through hole 271*a* of the first slider 271. A nut 409 is fastened on the external thread 405 of the pin 401 to connect the first slider 271 and the door glass 251.

Here, the connection structure between the second slider 273 and the door glass 251 is similar to that of the first slider 271. The connection structure between the third slider 275 and the door glass 251 is also similar excepting that the shape of the third slider 275 is different from that of the first slider 271.

In the space inside of the door panel, there is disposed a drum 283, which is rotationally driven by a motor 281. Two wires 285 and 286 are made to run on the drum 283. These wires 285 and 286 are wound in such directions that the wire 285 is let off whereas the wire 286 is taken up as the drum 283 is turned in the direction of arrow of FIG. 15.

The leading end portion of the wire 285 is introduced into the front frame 253 through a pulley 287 disposed at the upper portion of the front frame 253 and is directly retained at the upper portion of the first slider 271.

The leading end portion of the wire 286 is introduced into the rear frame 255 through a guide 289 disposed in the rear frame 255 and is directly retained at the lower portion of the second slider 273.

The front frame 253 is provided with a bracket 291 extending in the longitudinal direction of the front frame 253. As shown in section in FIG. 16, the bracket 291 is composed of: a root portion 293 which is fixed at its base end portion on the base portion 257 of the front frame 253 and extended toward the car body 259; and a bent portion 295 which is bent from the leading end of the root portion 293 toward the outside of the car body 259. Moreover, the root portion 293 and the bent portion 295 are provided with a weather strip 297 and a weather strip 299 to be pushed onto the car body 259.

The upper portion of the front frame 253 and the upper portion of the rear frame 255 are spanned with an upper frame 301, as shown in FIG. 15.

A pulley 303 is disposed as a guide member at the lower portion of the front frame 253. A guide 305 is disposed at the connection portion between the front frame 253 and the upper frame 301. Moreover, a middle wire guide 307 is disposed in an arcuate portion 301*a* of the upper frame 301.

A guide 309 is disposed at the connection portion between the upper frame 301 and the rear frame 255. A wire 311 is retained at the lower portion of the first slider 271. This wire 311 is tensed at first downward and is then reversed about 180 degrees by the pulley 303. After this, the wire 311 is extended through the space (as referred to FIG. 16) defined by the first side face portion 261 of the front frame 253 and by the root portion 293 and the bent portion 295 of the bracket 291, and is retained at the upper portion of the second slider 273 through the guide 305, the middle wire guide 307 and the guide 309.

The return portion R can be formed by disposing the pulley 303 at the lower portion of the front frame 253 so that the first slider 271 and the second slider 273 can be moved up and down in the same directions.

In the third embodiment, too, the wire 285, the wire 286 and the wire 311 form an annularly tensed continuous wire. In this continuous wire, moreover, there is formed the return portion R to run in the opposite direction. The first slider 271 acting as the first wire fixing member is retained by the return portion R to go up and down along the front frame 253, and the second slider 273 acting as the second wire fixing member is retained by the wire portion to go up and down along the rear frame 255.

Here will be described the actions of the third embodiment. As the drum 283 is turned in the direction of arrow by the motor 281 with the door glass 251 being in the fully closed state, as shown in FIG. 15, the wire 285 is let off from the drum 283, and the wire 286 is taken up on the drum 283. Therefore, the first slider 271 and the second slider 273 go down so that the door glass 251 also goes down. This downward movement is possible up to the fully open state, as indicated by a double-dotted line, in which the upper end of the door glass 251 comes to the lower side of the belt line BL.

As the drum 283 is turned in the opposite direction of the arrow direction of FIG. 3 by the motor 281 with the door glass 251 being in the open state, on the contrary, the wire 285 is taken up on the drum 283, and the wire 286 is let off from the drum 283. In this case, the first slider 271 and the second slider 273 go up so that the door glass 251 also goes up.

In the third embodiment, the construction for functioning to move the door glass 251 up and down, i.e., the construction including the wire 285, the wire 286, the wire 311, the first slider 271 and the second slider 273 is disposed along the front frame 253, the upper frame 301 and the rear frame 255. What exists in the space at the center of the inside of the door frame is the drum 283 for moving the wire back and forth and the wires 285 and 286 for moving toward the drum 283, so that the construction can make effective use of the space inside of the door panel like the first and second embodiments.

In this embodiment, there is no intersection among the wire 285, the wire 286 and the wire 311, as shown in FIG. 15. Therefore, these wires generate no interference noise even if they are flapped by vibrations or the like.

Figure 16:
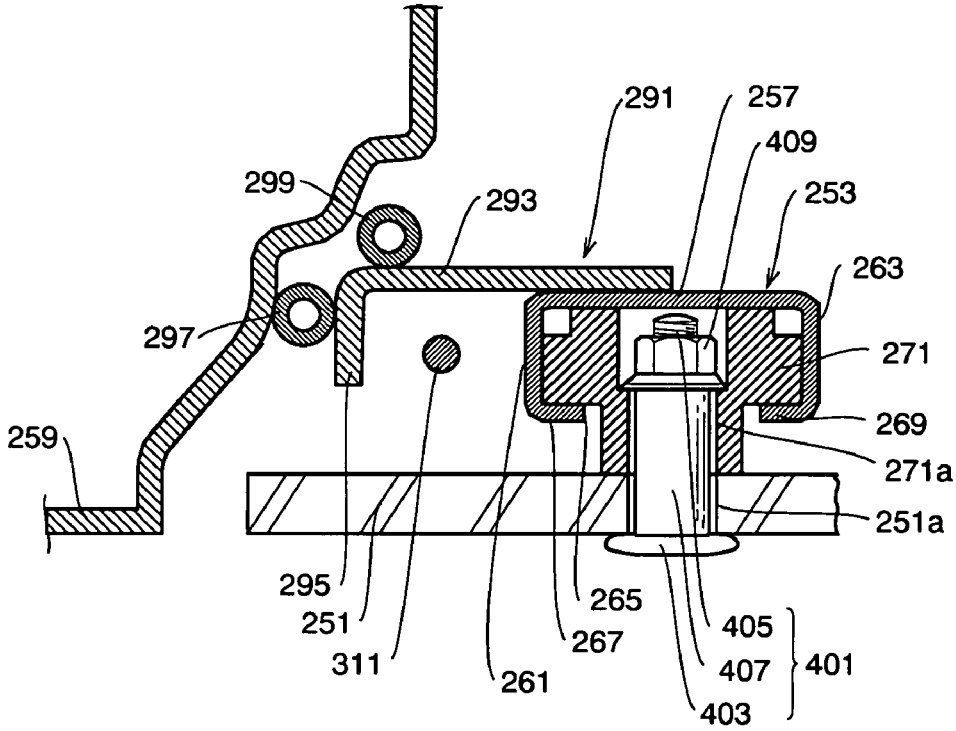
FIG. 16 is a sectional view taken along line XVI—XVI of FIG. 15.

As shown in FIG. 16, moreover, the front frame 253 and the rear frame 255 are provided with the groove 265 having an opening on the outer side of the car body. The first slider 271 and the second slider 273 are mounted on the door glass 251 through the groove 265 so that the door glass 251 and the car body 259 can be made flush with each other.

Moreover, the second slider 273 is mounted on the upper portion of the door glass 251 so that it pulls up the door glass 251 when the door glass 251 is to be moved upward. Therefore, the door glass 251 can be smoothly moved up and down without being dragged to cause a malfunction by the front frame 253 or the rear frame 255 (or their guide rail).

In most of the conventional constructions, in which the wire is to be retained by the slider, a base is attached to the slider, and the wire is retained by the base. In this embodiment, however, the wire is directly retained by the slider so that the construction can be made compact.

In those conventional constructions, moreover, a considerable space resides between the wire retaining portion of the base and the slider so that a moment acts on the slider thereby to obstruct the smooth upward and downward movements of the door glass. In this embodiment, on the contrary, the moment is not generated to ensure the smooth upward and downward movements of the door glass 251 since the wire is directly retained to the first slider 271 and the second slider 273.

In the case of this embodiment, moreover, the pin 401 is inserted from the outside of the door glass 251 into the through hole 251*a* of the door glass 251 and the through hole 271*a* of the first slider 271, and the nut 409 is fastened on the external thread 405 of the neck portion 407 of the pin 401, so that the first slider 271 and the door glass 251 are connected to each other. Therefore, their disconnection can be made by loosening the nut 409 from the inner side of the door glass 251. In other words, the connection between the door glass 251 and the first slider 271 cannot be released from the outer side of the vehicle so that the construction is excellently burglarproof.

Here, the connection structure between the second slider 273 and the door glass 251 is identical, and the connection structure between the third slider 275 and the door glass 251 is also identical excepting that the shapes are different between the first slider 271 and the second slider 273. Likewise, the connection between the door glass 251 and the second and third slider 273 and 275 cannot be released from the outer side of the vehicle. Thus, those connection structures are also excellently burglarproof.

Moreover, this embodiment has a plurality of sliders, that is, the first slider 271, the second slider 273 and the third slider 275 so that it can achieve the smooth upward and downward movements of the door glass 251.

Of the first slider 271, the second slider 273 and the third slider 275, moreover, those other than the second slider 273 are located below the belt line BL, i.e., in the door panel so that the first slider 271 and the third slider 275 are hidden to give a neat appearance.

Figure 17:
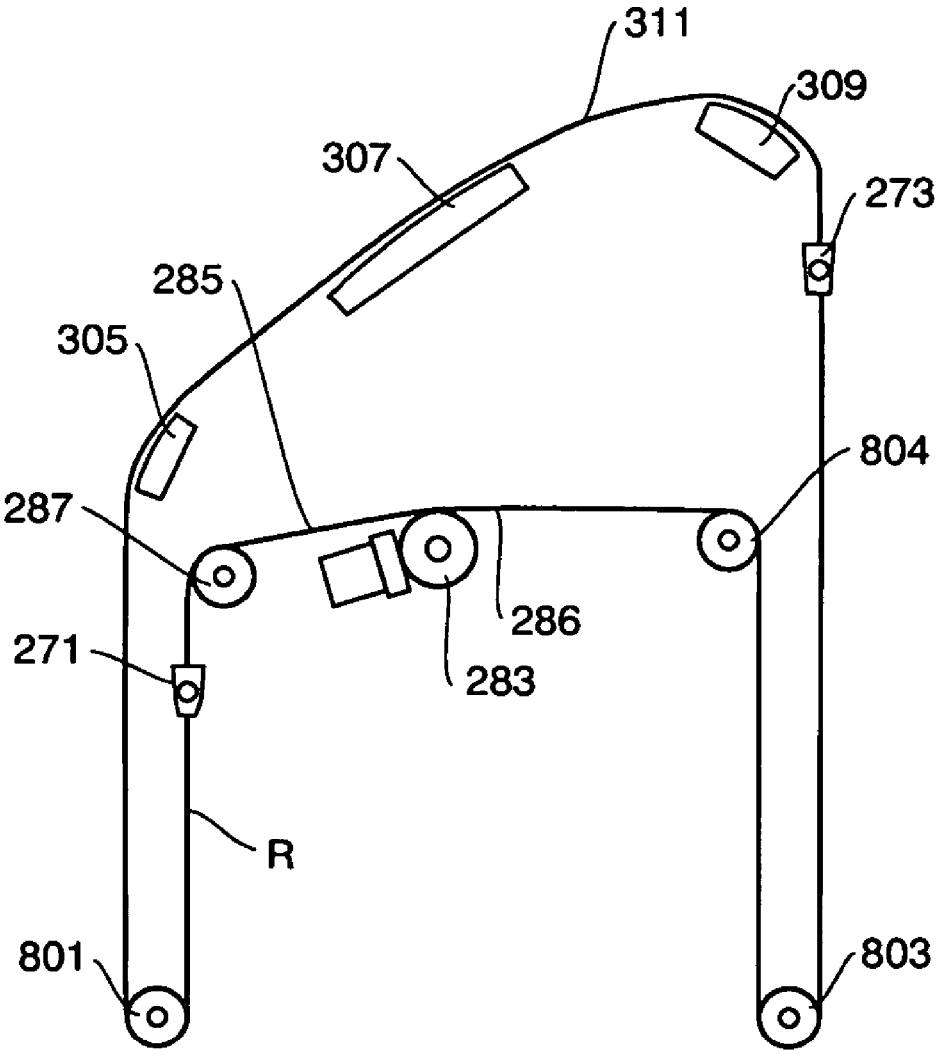
FIG. 17 is a diagram showing a modification of the third embodiment.

Here, this embodiment can also be modified in the following manners. In the construction shown in FIG. 15, for example, the guide member (or the pulley 303) for reversing the moving direction of the wire about 180 degrees is disposed at the lower portion of the front frame 253, but the construction may be modified into that shown in FIG. 17. In FIG. 17, the overlapping description is omitted by designating the same portions as those of FIG. 15 by the common reference numerals. At the lower portion of the front frame 253 and the lower portion of the rear frame 255, respectively, there are disposed a pulley 801 and a pulley 803 acting as guide members for reversing the wire moving directions about 180 degrees. On the other hand, a pulley 804 turns the direction of the wire 286 toward the pulley 803. Moreover, the first slider 271 is interposed between the pulley 287 and the pulley 801. The second slider 273 is interposed between the guide 309 and the pulley 803. With this construction, too, the return portion R is formed so that the first slider 271 and the second slider 273 can be moved in the same direction by turning the drum 283.

Figure 18:
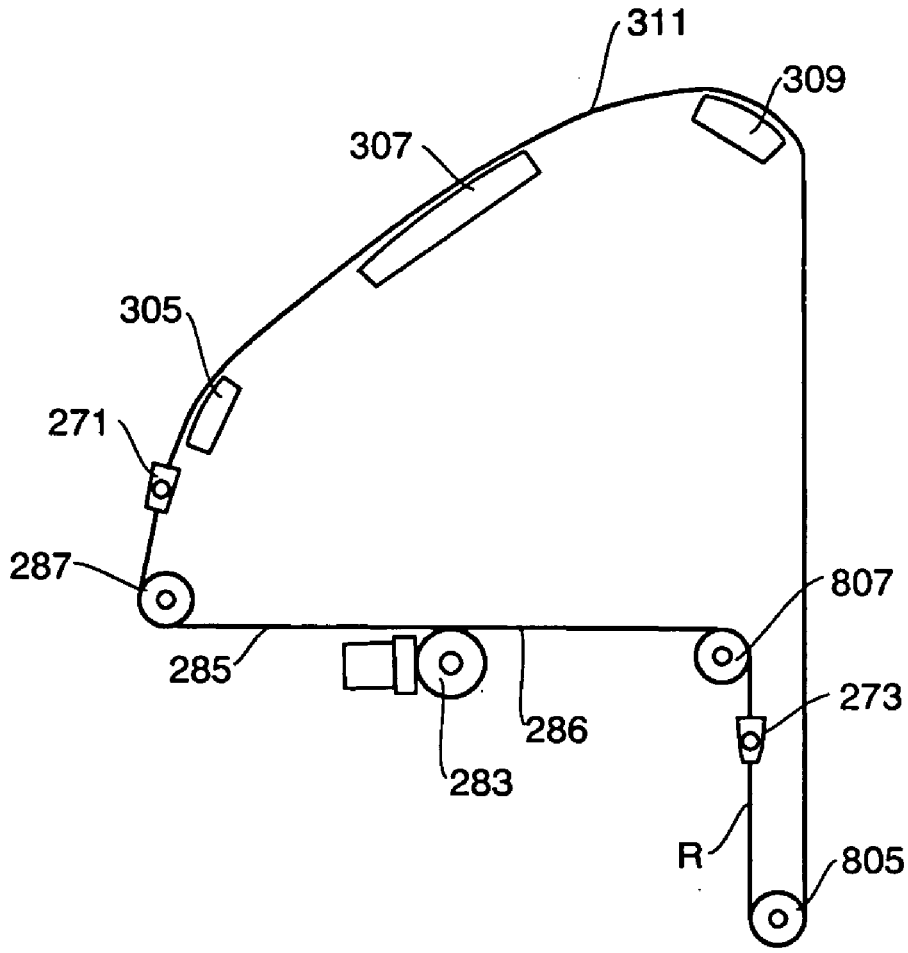
FIG. 18 is a diagram showing a modification of the third embodiment.

Moreover, the construction may also be modified, as shown in FIG. 18. In FIG. 18, the overlapping description is omitted by designating the same portions as those of FIG. 15 by the common reference numerals. At the lower portion of the rear frame 255, there is disposed a pulley 805 acting as a guide member for reversing the moving direction of the wire about 180 degrees. On the other hand, a pulley 807 turns the direction of the wire 286 toward the pulley 805. Here, the spacing between the guide 305 and the pulley 287 is set at or more than the moving stroke of the door glass. Moreover, the first slider 271 is retained between the guide 305 and the pulley 287 by the wire 285 and the wire 311. On the other hand, the second slider 273 is interposed between the pulley 805 and the pulley 807. With this construction, too, the first slider 271 and the second slider 273 can be moved in the same direction by turning the drum 283.

In this embodiment, moreover, the pulley 303 is used as the guide member for reversing the wire direction about 180 degrees, but may be replaced by the stationary guide used in the first and second embodiments.

In the embodiment, moreover, the wire 285, the wire 286 and the wire 311 are arranged in the front frame 253, the upper frame 301 and the rear frame 255, but may also be arranged outside and along the front frame 253, the upper frame 301 and the rear frame 255.

A fourth embodiment of the invention will be described with reference to FIG. 19 to FIG. 22.

Figure 19:
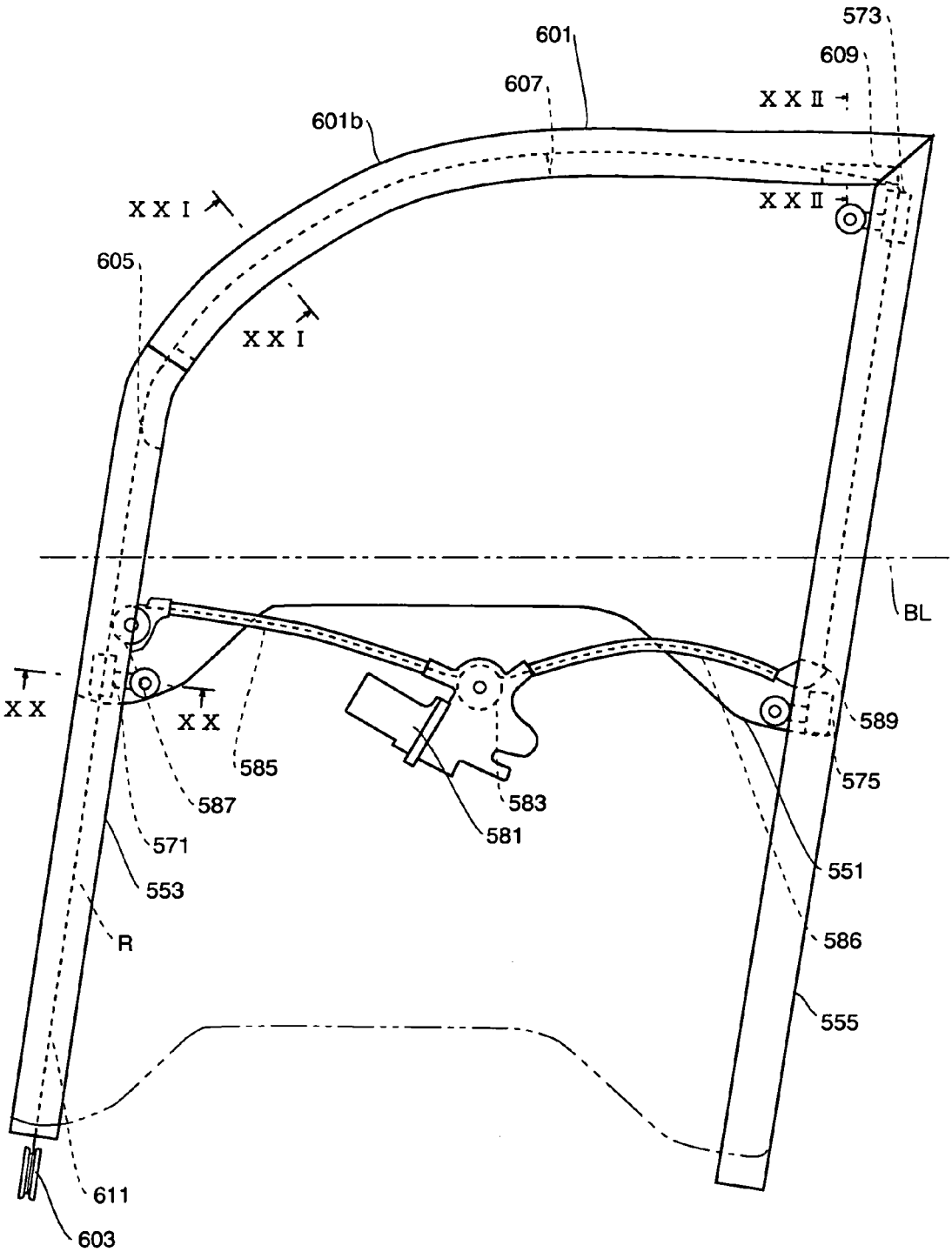
FIG. 19 is a construction diagram showing a fourth embodiment of a window regulator according to the invention.

In FIG. 19, the door is provided on its front side with a front frame 553 acting as a first frame extending in the directions for a door glass 551 to go up and down. The door is also provided on its rear side with a rear frame 555 as a second frame extending in the directions for the door glass 551 to go up and down.

The upper portion of the front frame 553 and the upper portion of the rear frame 555 are spanned with an upper frame 601.

Figure 20:
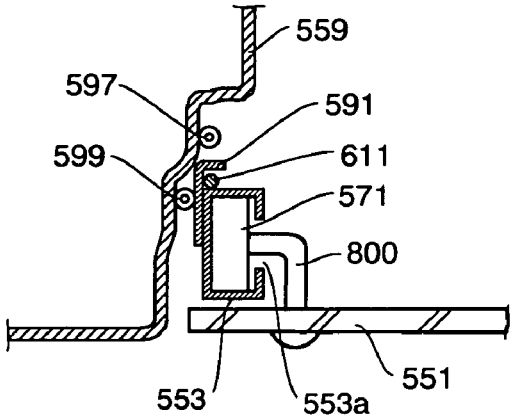
FIG. 20 is a sectional view taken along line XX—XX of FIG. 19.
Figure 21:
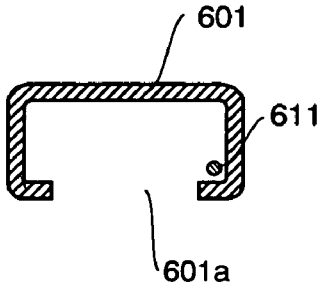
FIG. 21 is a sectional view taken along line XXI—XXI of FIG. 19.
Figure 22:
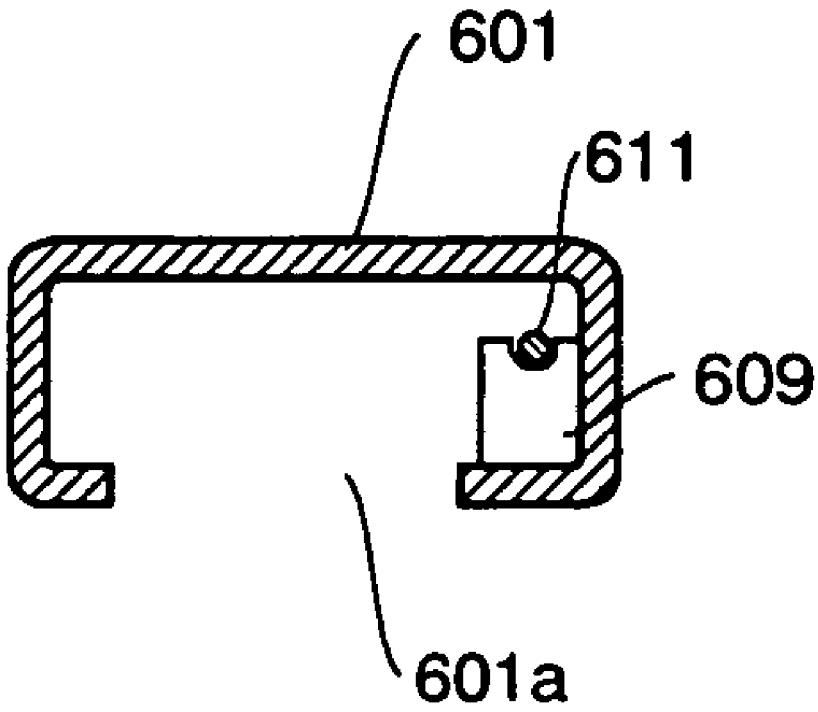
FIG. 22 is a sectional view taken along line XXII—XXII of FIG. 19.

As shown in FIG. 20 to FIG. 22, moreover, the front frame 553, the upper frame 601 and the rear frame 555 are provided with grooves (of which only a groove 553*a* and a groove 601*a* are shown) having openings in the faces other than those confronting the outer side of the car body.

With the front frame 553, there movably engages a first slider 571, which is connected through the groove 553*a* of the front frame 553 to the lower portion of the front side of the door glass 551.

With the rear frame 555, there movably engages a second slider 573 having the same shape as that of the first slider 571. Like this first slider 571, the second slider 573 is connected through the groove of the rear frame 555 to the upper portion of the rear side of the door glass 551.

In this embodiment, moreover, a third slider 575 movably engages with the rear frame 555 and is connected to the lower portion of the rear side of the door glass 551 through the groove of the rear frame 555.

Here will be described the connection structure between the first slider 571 and the door glass 551 with reference to FIG. 20. The connection structures between the second and third sliders 573 and 575 and the door glass 551 are identical, and their overlapping description is omitted.

The first slider 571 is attached to the lower portion of the front side of the door glass 551 through the groove 553*a* of the front frame 553 by means of an L-shaped pin 800.

In the door panel arranged below the belt line BL, as shown in FIG. 19, there is disposed a drum 583, which is rotationally driven by a motor 581. Two wires 585 and 586 are made to run on that drum 583. Specifically, the wire 585 and the wire 586 are wound such that the wire 585 is let off whereas the wire 586 is taken up as the drum 583 is turned in one direction.

The leading end portion of the wire 585 is introduced into the front frame 553 through a pulley 587 disposed at the upper portion of the front frame 553, and is directly retained by the upper portion of the first slider 571. On the other hand, the leading end portion of the wire 586 is introduced into the rear frame 555 through a guide 589 disposed in the rear frame 555, and is directly retained by the lower portion of the second slider 573.

As shown in FIG. 20, moreover, a bracket 591 is attached to the front frame 553 along the longitudinal direction of the front frame 553. Moreover, the bracket 591 is provided with a weather strip 597 and a weather strip 599 to be pushed onto a car body 559.

As shown in FIG. 19, a pulley 603 is disposed at the lower portion of the front frame 553. A guide 605 is disposed at the connection portion between the front frame 553 and the upper frame 601. On the other hand, a middle wire guide 607 is disposed inside of an arcuate portion 601*b* of the upper frame 601.

A guide 609 is disposed at the connection portion between the upper frame 601 and a rear frame 555. A wire 611 retained by the lower portion of the first slider 571 is extended in the space (as referred to FIG. 20) between the front frame 553 and the bracket 591 through the pulley 603 and is retained by the upper portion of the second slider 573 through the guide 605, the middle wire guide 607 and the guide 609.

With the presence of the pulley 603, the wire 585 retained by the first slider 571 and the wire 611 retained by the second slider 573 move in the same directions.

In the fourth embodiment, too, the wire 585, the wire 586 and the wire 611 form an annularly tensed continuous wire. In this continuous wire, moreover, the return portion R to run in the opposite direction is formed by the pulley 603. The first slider 571 acting as the first wire fixing member is retained by the return portion R to go up and down along the front frame 553, and the second slider 573 acting as the second wire fixing member is retained by the wire portion to go up and down along the rear frame 555.

In this fourth embodiment, too, the space inside of the door panel can also be effectively utilized like the first to third embodiments.

According to this construction, moreover, the grooves 553*a* and 601*a* having the openings in the faces other than the face confronting the outer side of the car body are formed in the front frame 553, the upper frame 601 and the rear frame 555 so that those grooves cannot be seen from the car outside thereby to improve the appearance.

According to this embodiment, like the third embodiment, the second slider 573 is connected to at least one point of the upper portion of the door glass 551. Therefore, this door glass 551 is pulled up in case it is moved upward. As a result, the door glass 551 can be smoothly moved up and down without being dragged to cause a malfunction by the guide rails or the like.

In the embodiments other than that shown in FIG. 18, the first frame on the side where the return portion is formed in the wire is used as the front frame. On the contrary, the first frame may also be used as the rear frame.

According to the invention, as has been described hereinbefore, it is possible to realize the window regulator which can make effective use of the space in the door panel.

Here, the invention should not be limited to the foregoing first to fourth embodiments but could be modified and practiced in various manners within the spirit of the invention and the scope to be defined in claims.

The invention claimed is:

1. A window regulator comprising:

a first frame disposed on one side of the longitudinal direction of a door and extending in the directions for a door glass to go up and down;

a second frame disposed on the other side of the longitudinal direction of said door and extending in the upward and downward directions of the door glass;

an upper frame disposed to span the upper portion of said first frame and the upper portion of said second frame and disposed above a beltline of the door;

a wire tensed in an annular shape along said first frame, said upper frame and said second frame and having a return portion for a backward run in said first frame;

a first wire fixing member disposed on one side of the longitudinal direction of the door glass and retained by the return portion of said wire to move along said first frame;

a second wire fixing member disposed on the other side of the longitudinal direction of the door glass and retained by the wire portion to move along said second frame; and a drum disposed on the inner side of a door panel of said door and wound with a portion of said wire for moving the annularly tensed wire back and forth when it is turned.

2. A window regular in claim 1, wherein said first frame and said second frame include glass runs extending in the upward and downward directions of the door glass and having lips abutting against the surface and the back face of the door glass for retaining the door glass, wherein said upper frame includes a glass run having a lip abutting against the surface and the back face of the door glass for retaining the door glass, and wherein over the belt line, said wire is arranged in said glass runs, and said second wire fixing member goes up and down in said glass run.

3. A window regulator in claim 1 or 2, wherein said first frame includes a guide member for reversing the moving direction of said wire 180 degrees thereby to form said return portion.

4. A window regular in claim 1 or 2, wherein said drum is disposed at a portion below the belt line of said first frame.

5. A window regulator in claim 4, wherein said drum is rotatably housed in a drum housing disposed at the lower portion of said first frame, wherein said drum housing includes a wire guide for guiding the wire portion let off from said drum and the wire portion taken up on said drum, and wherein said wire guide has a stopper for abutting against the door glass when the door glass goes down to the lowermost position.

6. A window regulator in claim 1 or 2, wherein said first wire fixing member includes a slider engaging with said first frame for going up and down, and wherein said second wire fixing member includes a slider engaging with said second frame for going up and down.

7. A window regulator in claim 6, wherein said first frame and said second frame are provided with grooves having openings in the faces other than those confronting an outer side of a car body, and wherein said sliders are connected to the door glass through said grooves.

8. A window regulator in claim 1 or 2, wherein said second wire fixing member is disposed at the upper portion of the door glass.

* * * * *